US011364729B2

(12) United States Patent
Vandevelde

(10) Patent No.: US 11,364,729 B2
(45) Date of Patent: Jun. 21, 2022

(54) TRACING ON A METAL SHEET INTENDED FOR USE IN SHEET METAL WORK

(71) Applicant: BKE-MACHINES INTERNATIONAL SA, Falisolle (BE)

(72) Inventor: Pierre Vandevelde, Gosselies (BE)

(73) Assignee: BKE-MACHINES INTERNATIONAL SA, Falisolle (BE)

( * ) Notice: Subject to any disclaimer, the term of this patent is extended or adjusted under 35 U.S.C. 154(b) by 3 days.

(21) Appl. No.: 16/971,818

(22) PCT Filed: Feb. 21, 2019

(86) PCT No.: PCT/EP2019/054280
§ 371 (c)(1),
(2) Date: Aug. 21, 2020

(87) PCT Pub. No.: WO2019/162361
PCT Pub. Date: Aug. 29, 2019

(65) Prior Publication Data

US 2021/0362512 A1 Nov. 25, 2021

(30) Foreign Application Priority Data

Feb. 26, 2018 (BE) ..... 2018/5113

(51) Int. Cl.
*B41J 3/413* (2006.01)
*B41M 5/00* (2006.01)

(52) U.S. Cl.
CPC ..... *B41J 3/413* (2013.01); *B41M 5/0047* (2013.01); *B41M 5/0058* (2013.01)

(58) Field of Classification Search
CPC ..... B41J 3/413; B41M 5/0047
See application file for complete search history.

(56) References Cited

U.S. PATENT DOCUMENTS 4,144,808 A * 3/1979 Iwasa ..... B21C 51/005 101/494

FOREIGN PATENT DOCUMENTS

EP 0489345 A2 6/1992
JP H11207664 A 8/1999
KR 101500236 B1 * 3/2015
(Continued)

OTHER PUBLICATIONS

Kim et al, MachineTranslationofKR 101500236 B1, 2015 (Year: 2015).*

(Continued)

*Primary Examiner* — Scott A Richmond
(74) *Attorney, Agent, or Firm* — Cantor Colburn LLP

(57) ABSTRACT

A method of marking on sheet metal includes the following steps:

preparing marking information in digital format;

transmitting the marking information to a marking system's control unit also having a system for driving the sheet metal; a system for braking the sheet; and a marking head; and inserting the sheet metal into the braking system and into the drive system. The method further includes the steps of exerting a drive force on the sheet metal in a drive direction;

exerting a braking force on the sheet metal opposing the driving force, so as to tension and flatten the sheet metal; and marking the marking information on the tensioned sheet metal using the marking head, set in a marking plane.

20 Claims, 4 Drawing Sheets

(56) References Cited

FOREIGN PATENT DOCUMENTS

| | | | |
|---|---|---|---|
| WO | 2008150143 | A2 | 12/2008 |
| WO | 2016017113 | A1 | 2/2016 |
| WO | 2017078433 | A1 | 5/2017 |

OTHER PUBLICATIONS

International Search Report dated May 23, 2019 re: Application No. PCT/EP2019/054280, pp. 1-2, citing: WO 2008150143 A2, JP H11207664 A, EP 0489345 A2 and WO 2017078433 A1.

* cited by examiner

TRACING ON A METAL SHEET INTENDED FOR USE IN SHEET METAL WORK

TECHNICAL FIELD

This disclosure generally concerns the sheet metal work parts manufacturing sector and in particular for the insulation of heat transfer fluid pipes and ventilation (HVAC). It concerns more particularly the marking out stage in the manufacture of such parts.

BACKGROUND

In the sheet metal work field, parts are generally made from flat sheets of metal, which are cut, shaped and assembled to obtain a custom part suitable for the space available for its installation.

In order to obtain a volume part from flat sheet metal, a tracing is first made on the surface of the sheet metal. This tracing or marking out defines the cutting lines corresponding to a projection or development of the desired final shape.

Once the marking out has been done on the flat sheet metal, the parts are cut and shaped for assembly. The parts can also be punched or undergo further processing, such as bending, moulding or forming, until the desired geometric shape is achieved.

In sheet metal work, the marking out is generally done by hand with a tolerance below one millimetre over lengths of several metres. Traditionally, the marker works directly on the sheet metal. The marker uses a range of tools, including a scriber that allows it to indelibly mark shapes on the sheet metal using notches.

Marking out is a full-fledged sheet metal work discipline that uses graphical methods to approximate and optimise the sheet metal surface area required to form developable and non-developable surfaces, such as elliptical surfaces, spherical elements, or conoidal shapes. The job of marker therefore requires both good physical condition and intellectual discipline combined with knowledge of geometric tracing techniques. A marker is an expert who has studied the principles of solid geometry and projection on a plane. The profession is only accessible after long and demanding training. For this reason it is difficult to find markers, and the lack is felt on construction sites and in the manufacturing workshops.

The only alternative currently known to avoid the marking-out step—and the marker—is to produce sheets cut to size with a digitally controlled cutting machine. This machine makes it possible to cut a metal sheet automatically with a mechanical contact cutting tool, such as a cutting blade, or by melting the material. The shapes of the parts are programmed with the help of software and then communicated to the digital control machine which cuts the metal sheets according to the drawings obtained via the software. The part is therefore cut directly based on its digitised model. These specialised software programs make it possible to program the machine to cut the parts with a minimum of knowledge and/or quick training.

This solution makes it possible to do without a marker and to obtain custom-made parts by a less qualified worker.

However, the use of a digitally controlled cutting machine has several disadvantages, the most notable of which is its high initial investment, which only pays off after a certain number of cuts have been made.

Another disadvantage of a cutting machine is its lack of flexibility. Such a machine usually allows only one input material format. For example, a given machine will only be able to make cuts from flat sheet blanks or from sheets coming from coils, but rarely both.

In addition, digitally controlled cutting machines are bulky and are not designed to be transported to construction sites. The parts must be cut in the workshop and then brought to the construction site. Finished parts are more fragile than the original coils or sheet metal blanks, increasing the cost and time of transport.

There is no simple and inexpensive solution to replace the work of a marker.

SUMMARY

The purpose of the present disclosure is to provide a method of marking a sheet for use in sheet metal work, the method comprising the following steps:

- prepare marking information in digital format;
- transmitting the marking information to a marking system's control unit also comprising a system for driving the sheet metal; a system for braking the sheet; and a marking head;
- insert the sheet metal into the braking system and drive system;
- exert a driving force on the sheet metal with the drive system in one driving direction;
- exerting a braking force on the sheet metal with the braking system opposing the driving force, so as to tension and flatten the sheet metal; and
- marking the flattened, tensioned metal sheet by means of the marking head, which is arranged in a marking plane between the drive system and the braking system, the marking plane being at a distance d from the metal sheet.

This process solves both the problems associated with marking out by hand and those associated with the use of an automated cutting machine. It can be used to replace the job of marker-off on sheet metal work parts, without the disadvantages of current automated cutting machines.

The marking head is preferably an ink-jet print head using a quick-drying ink, preferably a solvent-based ink or a laser print head.

After marking, the parts can be cut, for example with manual scissors, electroportable shears, or a notching machine.

It is important to note that the sheet can be introduced first into the braking system and then into the drive system or vice versa.

The sheet metal intended for use in sheet metal work has a thickness of less than 10 mm, preferably between 0.4 mm and 1.5 mm.

Advantageously, the marking distance d between the head and the marking plane is less than 5 mm, and more preferably between 1 and 3 mm.

General Description of the Invention

In the context of the disclosure, the term "marking out" is used to designate the making of shapes on a sheet of sheet metal work by notching the surface of the metal. The layout can be made on steel, aluminium, copper, zinc, etc. sheet metal. In contrast, the term "marking" will refer to the printing of shapes on a sheet of sheet metal.

Marking out may therefore be replaced by a marking, such as an ink drawing, made on the sheet, provided that this drawing is sufficiently indelible. However, unlike paper, for which inkjet printing is commonly used, sheet metal does not absorb ink. This can lead to burrs/dirt or even to complete wiping. In addition, the surface finish of sheet metal used in sheet metal work is not always perfect and printing becomes even more difficult. Conventional water- and oil-based inks are not suitable because they dry slowly and adhere very little or not at all to metal surfaces.

It has been found that a completely acceptable result can be obtained by using a solvent-based ink, suitable for printing on non-porous surfaces, also known as quick-drying ink.

Quick-drying means an ink that is dry after a few tenths of a second. For example, Multiple Black AP ink from REAJET (Muhltal, Germany) is very suitable.

These inks have good adhesion to metal surfaces. The rapid evaporation of the solvent and the adhesion of the ink dried in this way offer a high-performance solution on a metal surface in the sheet metal work process.

Marking is preferably carried out by an automated system comprising an inkjet printhead. Inkjet printheads are well known and their use is widespread.

The inkjet printing technique requires a low and constant height between the projection head and the media to be printed. Variable height will result in too much or too little diffuse inkjet projection.

As an alternative to the inkjet print head, a laser print head can be used for marking sheet metal.

It has been observed that aluminium, steel and stainless steel sheets, generally in the form of flat sheet blanks, show a slight buckling of the material generated during its manufacture or packaging. On the other hand, flexible "sheets", such as sheets made of synthetic and/or rolled materials, such as plastics or PVC laminated with aluminium (see for example the company LENZING PLASTICS, Lenzing, Austria) have a greater elastic deformation than metal sheets and retain marked natural folds which make this type of flexible sheet difficult to handle flat.

These flatness defects can complicate the handling of the sheets when they are placed in the system and directly affect the performance of the marking. In order to achieve an accurate marking, the sheet metal must be flat so that a distance d can be maintained between the marking head and the sheet metal.

The method according to disclosure shall take into account all the observations mentioned above. The process makes it possible to replace a marking-out in the workshop without the assistance of a marker, using simple and cheap elements, and is versatile as regards the material of the sheets on which the marking-out is carried out. The process offers a concrete alternative, at an acceptable cost, to manual marking out.

Indeed, the combined action of the drive and braking systems makes it possible to tension and flatten the sheet metal and eliminate natural bending. The marking can then be carried out on a flat sheet metal surface with sufficient accuracy for sheet metal work applications.

Advantageously, the step of marking/printing on the tensioned sheet also includes the step of moving the tensioned sheet past the marking head by the combined actions of the drive and braking systems. This way, the sheet moves in front of the marking head and the marking head can simply move transversely to the movement of the sheet. The system for moving the marking head is simplified.

The process according to disclosure makes it possible to work with sheets from both pre-cut blanks and coils. The length of the sheets is independent of the capacity of the machine. This can be contrasted with automated cutting machines in which the length of the parts produced is directly proportional to the capacity of the table and the positioning of the material to be cut. For example, the length of the pieces is generally limited to about 3 metres.

Another advantage of the disclosure is that it allows the work to be organised and the flow of material to be optimum and economical. For example, preparation for marking can be carried out separately, once the marking has been carried out on the sheet metal in a workshop. The sheet can then be shipped to the site or remain in the workshop where subsequent operations can be performed by less qualified personnel.

In the process, the step of inserting the sheet metal into the drive and braking system preferably included the following steps:

- insert the sheet metal into the braking system;
- move the marking head from a working position in the marking plane to a parking position away from the marking plane;
- moving the braking system from a working position away from the drive system to an insertion position close to the drive system;
- insert the sheet metal into the drive system from the braking system;
- move the braking system from the insertion position to the working position;
- move the marking head from the parking position to the working position.

These steps make it easier to insert the sheet, for example, when it is a flexible sheet as defined above.

According to another aspect, the disclosure proposes a system for marking on a sheet intended for use in sheet metal work. The system comprises a control unit configured to control the system; a sheet driving system configured to exert a driving force on the sheet in a driving direction; a sheet braking system configured to exert a braking force on the sheet opposite to the driving force so as to tension the sheet; and a marking head. The marking head is arranged between the drive and the braking system.

This system is adapted to carry out the process according to disclosure. A person skilled in the art will understand that the system for stretching and flattening the sheet metal can include any system that uses mechanical effort.

Advantageously, the system also includes a sheet metal insertion device on which the braking system is mounted. The insertion device includes a means for translatory adjustment of the braking means between two positions:

- an insertion position in the vicinity of the drive system, in which the sheet metal can be inserted into the system; and
- a working position away from the drive system.

The insertion device allows the drive and braking systems to be brought closer together to reduce the travel of the sheet during its positioning and thus reduce the influence of the curvatures and bends of the sheet during its insertion.

Advantageously, the marking head includes means for translatory adjustment, in a direction perpendicular to the marking plane, between two positions: a working position in a marking plane, to optimise printing on the sheet; and a parking position away from the marking plane, to allow the insertion of a sheet into the system.

Preferably, the system further comprises a guide table placed between the braking system and the guiding system and configured to guide the sheet metal. The use of a guide table makes it easier to insert a metal sheet into the system. The guide table can replace an insertion device if the machine is mainly used to process stiff metal sheets.

Preferably, the marking head is configured to project an ink suitable for printing on non-porous surfaces, preferably a solvent ink. The ink must dry quickly, for example before it comes into contact with the drive system.

Advantageously, the driving and/or braking system act on the sheet metal by clamping.

In particular embodiments, the drive system comprises a pair of rollers including a drive roller driven in rotation by a motor, and a first pressure roller configured to press the sheet against the drive roller. Advantageously, the driving roller is made of steel, and the first pressure roller is made of rubber.

Depending on the variant, the drive roller is rotated by an electric motor. The drive system comprises a gear system, configured to control the rotation of the first pressure roller to that of the driving roller.

In the embodiments, the braking system comprises a pair of rollers including a guide roller, and a second pressure roller configured to press the sheet metal against the guide roller.

Preferably, the second pressure roller is configured to exert variable pressure on the sheet. This variable pressure directly modifies the clamping effect and therefore the tension effect of the sheet metal, for example depending on the material used.

Advantageously, the braking system is a felt press system. The felt press is a mechanically simple and low-cost component that can be used with a sheet of material that is not coated with plastic film or is not subject to scratching.

The system preferably includes a shear preferably placed downstream from the system. The shear allows the sheet to be cut to limit its length and simplify the transport of the marked sheet.

In preferred embodiments of the system according to disclosure, the system further includes a decambering device placed upstream from the system. Advantageously, the decambering device includes a guide table and three decambering rollers.

In searching for a solution, the inventor, based on his/her own observations of the constraints, was able to take paper printing systems into consideration. However, none of the known solutions are suitable for a sheet metal working application.

For example, an inkjet printing device is known in document WO 2008150143. This document discloses an ink jet printing system on metal parts for the repair of boat hulls. In this system, the print head is rotated in addition to translational movements. It is a very complex system that requires the print head to be mounted on a rotary system. The disadvantage of not providing for the insertion of coils of sheet metal is also found here.

Another known state of the art system is disclosed in document WO 2016017113 A1. The system includes a printing unit configured to print on the surface of a sheet metal from a coil. The reel is unwound on one input side of the machine and rewound on an output side. The sheet is transported in front of the printing unit around a rotating drum. The tensions created by the rollers at the input and output of the system hold the sheet metal against the rotating drum.

This system allows printing on a metal sheet and uses metal sheets from coils. However, the printing on the sheet is done by a complex system comprising a printing unit with seven printing heads and a drying unit for the printed ink.

In addition, this system works exclusively with sheet metal coils as input and output.

The systems presented above all have major common disadvantages. These are complex systems that involve high production costs. However, it is important in the context of the disclosure that the resulting system is cheaper than the automated cutting solution discussed above. Furthermore, the systems presented above are not suitable for processing metal sheets offered either as sheet blanks or as coil.

BRIEF DESCRIPTION OF THE DRAWINGS

Other features and characteristics of the disclosure shall be shown by the detailed description of at least one advantageous embodiment presented below, by way of illustration, with reference to the appended drawings. These show.

DETAILED DESCRIPTION OF THE DRAWINGS

Figure 1:
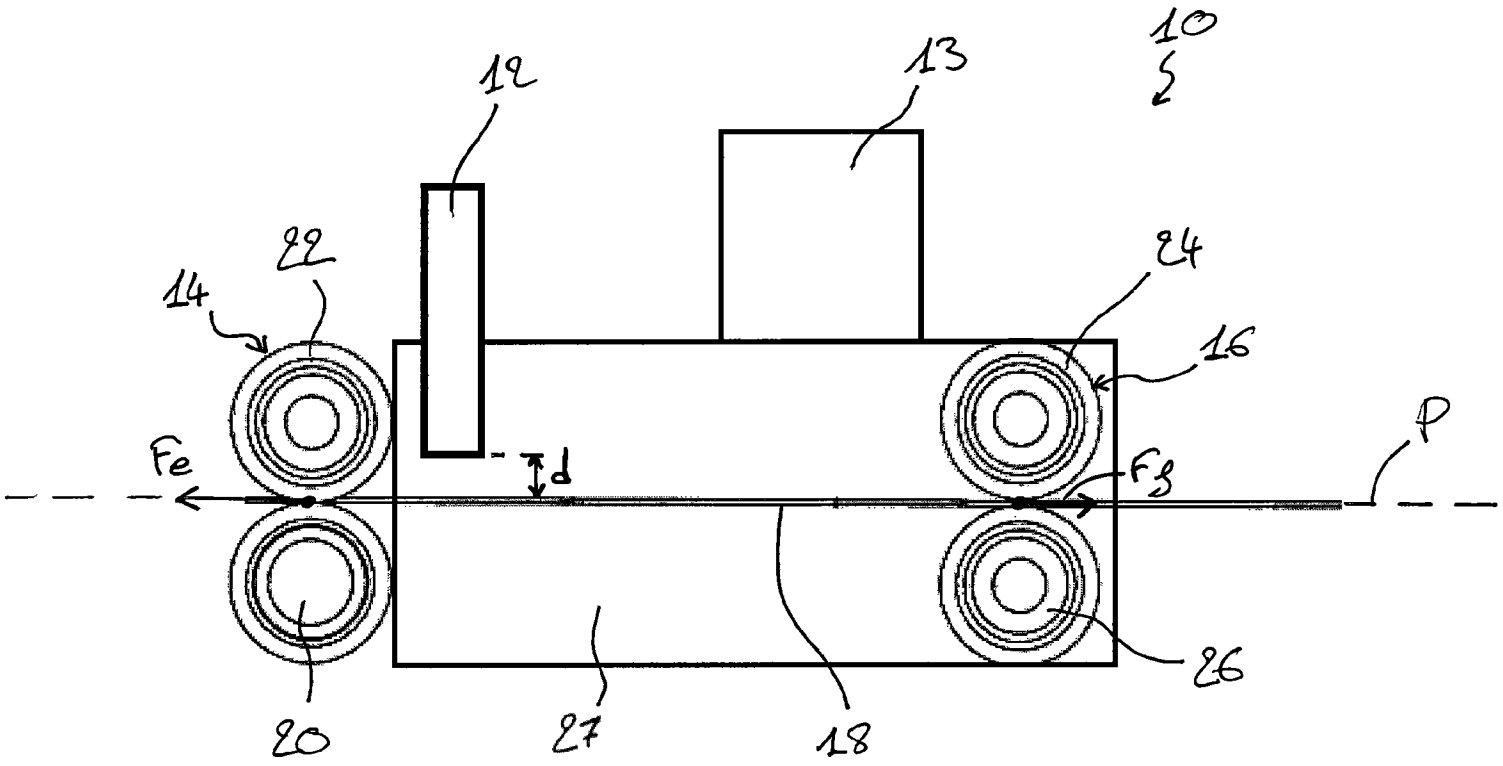
FIG. 1: a schematic side view of a marking system according to a preferred embodiment of the disclosure.

A preferred embodiment of system 10 according to disclosure is shown in FIG. 1 and comprising a marking head 12, a control unit 13 configured to control the marking head 12, a drive system 14, a braking system 16, and an insertion device 27. FIG. 1 shows system 10 in which a metal sheet 18 is inserted.

The control unit 13 contains all appropriate components. The control unit 13 allows the sheet metal to be marked by the marking head 12, but depending on the variant, the control unit can also be used to control, for example, the drive 14, brake 16, and insertion systems 27.

Control Unit 13 includes means of communication, not shown, with elements outside the system. Therefore the control unit 13 is capable of receiving information in digital format containing control information or information to be processed by the control unit and transmitting it into the system as commands.

In particular, the Control Unit 13 receives data containing drawings produced by CAD/CAM type software by means of which the shapes of the parts in three dimensions have been transformed into two-dimensional projections and on the basis of this data, the marking of the sheet metal will be carried out using the marking head.

The marking head 12 can be, for example, a suitable inkjet print head, or a laser print head, or any suitable print head. Laser printing is of course faster than inkjet printing. It is also and above all a more expensive system than a system using an inkjet head. But as the price difference narrows, laser printing could quickly become a preferred choice. In the following embodiments, an inkjet printhead is used as an example.

The ink used is a solvent-based ink that dries quickly on a metal surface.

The marking head 12 is mounted on a frame, not shown. It comprises means for translatory adjustment, not shown, along a marking plane, which is preferably horizontal. The marking head 12 also has means for translatory adjustment in a direction perpendicular to the marking plane. The translation of the head 12 in the direction perpendicular to the marking plane takes place between two positions: a working position in which the head is in the marking plane; and a parking position in which the head is away from the marking plane to allow the insertion of a metal sheet into the system.

The means of translatory adjustment of the marking head may include any suitable means such as a geared motor or hydraulic system.

Sheet 18 is made of a material suitable for sheet metal work such as steel, aluminium, stainless steel or compound material.

The sheet 18 is driven in front of the marking head in a plane parallel to the marking plane, from the braking system 16 to the drive system 14, along a line called the pass line P.

In the embodiment shown in FIG. 1, the drive unit 14 has two rollers, a drive roller 20 and an initial pressure roller 22. During operation, the two rollers 20, 22 are arranged on either side of sheet 18 and act on sheet 18 by clamping.

Engine cylinder 20 is a cylinder, preferably made of steel, driven in rotation by a motor, not shown. Any suitable motor can be used to drive the roller, such as an electric motor.

A gear system, not shown, can control the rotation of the first pressure roller 22 to that of the drive roller 20 so as to enhance the driving action of rollers 20, 22. Depending on the variant, the first pressure roller can instead be mounted so that it can rotate freely in relation to the frame.

The first pressure roller 22 here is a rubber roller configured to exert a pressing force on metal sheet 18. The resistance of the drive roller 20 to the pressure force, allows the sheet to be forced between the two rollers 20, 22 of the drive system.

When the drive roller 20 is rotated, sheet 18 pressed between the drive roller 20 and the first pressure roller 22 is driven in the direction of rotation of the drive roller 20. The drive direction corresponds to an orientation along the pass line P in the opposite direction to the braking system 16. The drive system 14 then applies a drive force to the metal sheet shown in FIG. 1 by an arrow Fe in the drive direction.

Advantageously, the first pressure roller includes a clamping device, not shown, which allows the distance between the rollers of the drive system to be adjusted and a variable clamping force on the metal sheet to be achieved.

The braking system 16 is mounted on the insertion device 27. The insertion device 27 is symbolised by a rectangle in the Figures. It serves as a support for the brake system 16, and has means for translatory adjustment of the braking system 16 between an insertion position close to the drive system 14 and an operating position away from the drive system 14. A person skilled in the art will understand that any suitable means of movement can be used, such as a guide rail and/or wheels.

The braking system 16 here comprises two preferably rubber rollers, one guide roller 24 and a second pressure roller 26. Similarly to the drive system, the two rollers 24 and 26 are, when operating, on either side of sheet 18 and act on sheet 18 by clamping.

Guide roller 24 serves as a support for sheet metal 18. Guide roller 24 can be mounted so that it can rotate freely in relation to the insertion device 27.

The braking system 16 can be actuated between an open position in which the second pressure roller 26 is away from the guide roller 24; and a closed position in which the second pressure roller 26 presses against the guide roller 24. The application of the braking system 16 may be controlled manually or by any appropriate means.

When the drive system 14 drives the sheet 18, the sheet 18 moves into the braking system 16 causing the rollers of the braking system 16 to rotate against the inertia of the rollers. This inertia creates a braking force shown in FIG. 1 by an arrow Ff exerted on the sheet 18 in the opposite direction to the drive force Fe. The braking force Ff is directly related to the slip at the contact between the sheet 18 and the braking system 16.

The pressing force of pressure roller 26 is preferably variable. Therefore, the braking force Ff can be determined and controlled by the pressure force exerted by the second pressure roller.

The interplay of the braking and driving forces is designed to move the sheet along the pass line P in front of (below) the marking head, which moves transversely to the pass line P. This makes it possible to mark the sheet over its entire width and length.

In order for sheet metal 18 to run along the pass line P, the drive force Fe must obviously be greater than the braking force Ff.

It is of course also possible to move the marking head in two directions in the marking plane and keep the sheet stationary (with equal drive and braking forces).

Figure 2:
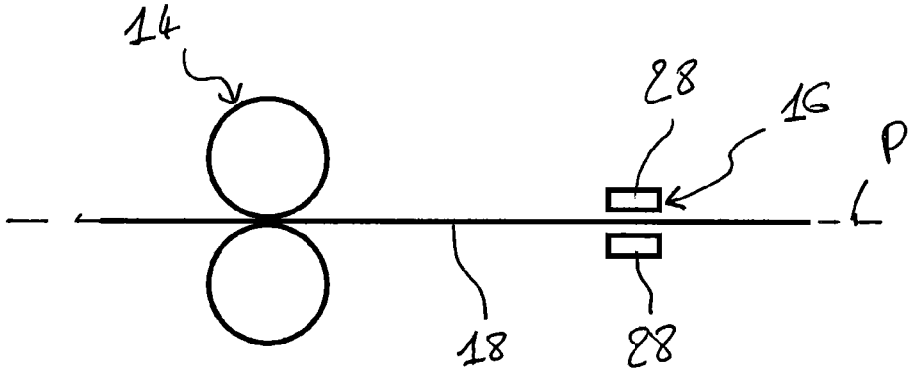
FIG. 2: a simplified schematic side view of a marking system according to another preferred embodiment of the disclosure.

In another embodiment, as shown in FIG. 2, the braking system 16 has a felt press. The felt press comprises two felt blocks 28, which in operation are arranged on either side of sheet 18, and a variable clamping device, not shown, for clamping the two felt blocks 28 against sheet 18. The felt press can be mounted in translation in relation to the insertion device 27 and acts as a guide while at the same time exerting a braking force on the sheet metal. Any suitable variable clamping device can be used, e.g. hydraulic or pneumatic pistons, or a mechanical clamping system.

The use of a felt press is limited in the case of sheets made of material not coated with plastic film or not subject to scratching. A felt press in the braking system is advantageous because it is inexpensive compared to cylinders.

During operation, the drive system 14 and the braking system 16 apply opposing forces Fe and Ff, respectively, to the sheet metal 18. The sheet metal 18 is then tensioned between the drive and braking systems 14, 16. This tensioning eliminates wrinkles on sheet metal 18 and provides a flat printing surface. The surface of sheet metal 18 is then easily held in a parallel plane at a predetermined distance d from the marking plane.

Figure 3:
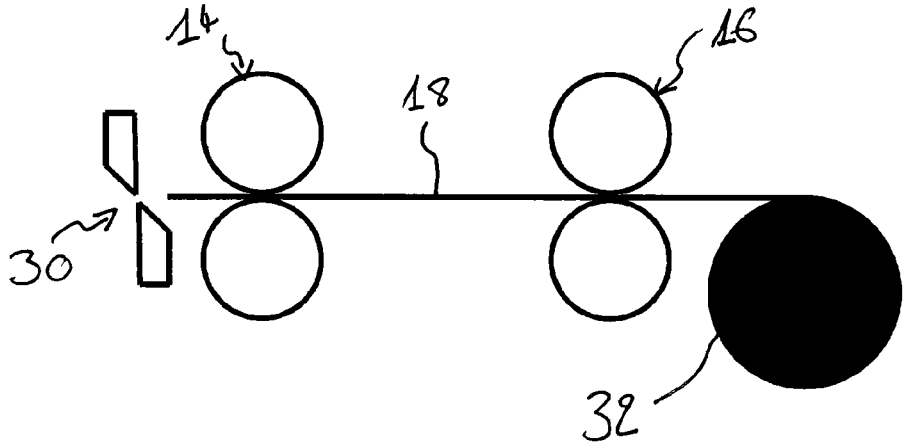
FIG. 3: a simplified schematic side view of a marking system according to another preferred embodiment of the disclosure.

In an embodiment shown in FIG. 3, the system also includes a shear 30 to cut the sheet over its entire width. Shear 30 is preferably used when sheet 18 comes from coil 32 and only part of coil 32 is required for a project. Shear 30 can also be useful in all cases where the sheet has to be divided into shorter sections.

Shear 30 is advantageously installed at the exit of the system, i.e. after the drive means in the drive direction, so as to keep the sheet inserted between the drive and braking means. Shear 30 can also be installed at the entrance of the system, before the braking system in the drive direction, or in any other suitable position.

An embodiment of the process of marking on a metal sheet intended for use in sheet metal work according to disclosure will now be described with reference to the system shown in FIG. 1.

First of all, the marking information is prepared. This preparation can be done on a separate system with drawing software or specialised sheet metal work software. The software provides sufficient support for this step to be performed by a technician less qualified than a marker.

In addition to marking shaped parts, it is advantageous to mark on the material additional information such as the part number in an assembly (e.g. a bend can comprise several segments). This processing of information on the sheet metal provides an additional guarantee of the quality of the manufacture of the parts, and limits human intervention. On automated cutting machines, this is done by printing on a paper label which is then affixed manually. In this disclosure, human intervention is more efficiently carried out upstream during the creation of the marking information.

Once the information has been prepared, it is transmitted to the Control Unit 13. Data transmission can be done by any appropriate means such as a wired or wireless network.

Before starting to mark the sheet metal, the sheet metal is inserted into the braking system 16 and into the drive system 14. Preferably from the braking system 16 to the drive system 14.

The process of inserting the sheet metal into the system depends on the nature of the sheet metal as described above. A distinction is made between the insertion of a stiff sheet, the insertion of a flexible sheet, the insertion as a sheet blank and the insertion of sheet from coils.

Figure 4A:
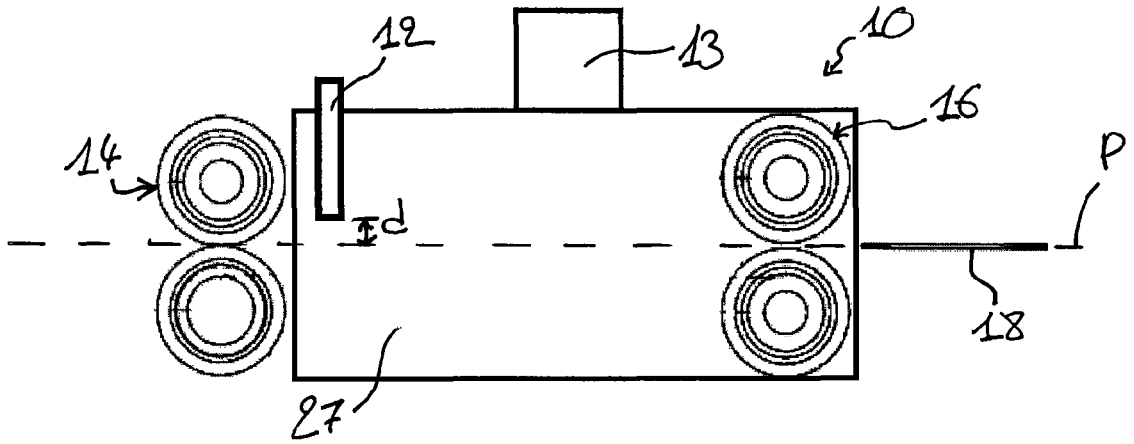
FIGS. 4*a* to 4*c*: schematic side views showing the steps of an embodiment of the process according to disclosure with the system from FIG. 1, for the insertion of a stiff metal sheet.
Figure 4B:
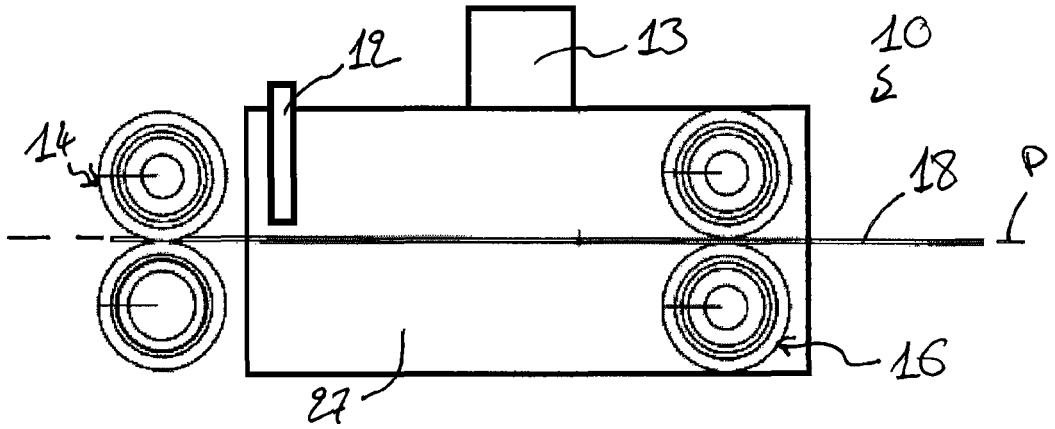
Figure 4C:
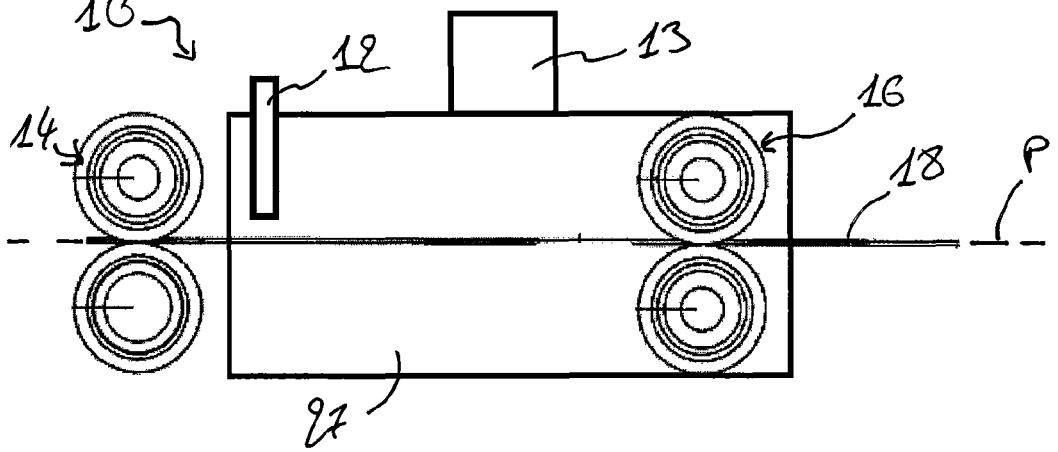

The insertion of a stiff sheet metal, e.g. a flat sheet metal blank, is described with reference to FIGS. 4*a* to 4*c*.

The marking head 12 is in the working position and the braking system 16 is open. The sheet 18 is inserted between the cylinders of the braking system 16.

The sheet 18 is pushed manually or mechanically into the braking system, i.e. between the second pressure roller 26 and the guide roller 24. The sheet 18 is pushed into the drive between the first pressure roller 22 and the drive roller 20.

Once the sheet is inserted into the drive system 14, the second pressure roller 26 is moved against the sheet metal to bring the braking system 16 into the closed position. The sheet 18 is then held by clamping in the braking system 16.

Then the sheet 18 is pushed or pulled into the drive system between the first pressure roller 22 and the drive roller 20.

The drive roller 20 is switched on and the drive system 14 exerts a driving force on the sheet 18 in the drive direction. Braking system 16 exerts a braking force in the opposite direction to the driving force in order to tension the sheet metal.

Sheet 18 is then tensioned and has a flat surface on which the marking head is able to carry out the marking.

The insertion of a flexible sheet metal from a coil of sheet metal is now described with reference to FIGS. 5*a* to 5*d*.

First of all, brake system 16 is open. The sheet is pushed manually or mechanically into the braking system 16, i.e. between the second pressure roller 26 and the guide roller 24.

Once the sheet is inserted into the braking system, the second pressure roller 26 is moved against the sheet 18 to bring the braking system 16 into the closed position. The sheet is then held by clamping in the braking system 16.

Figure 5A:
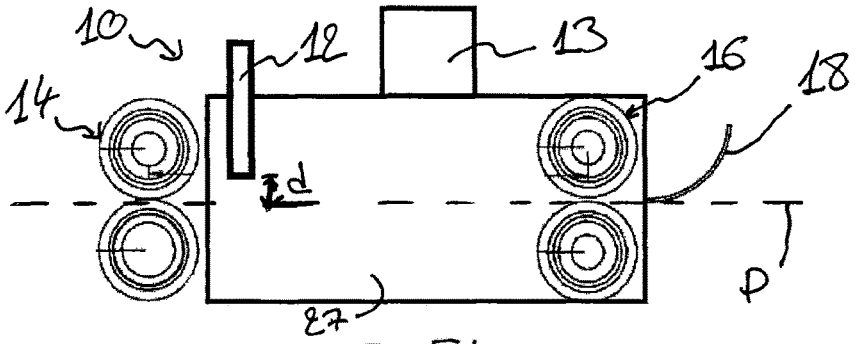
FIGS. 5*a* to 5*d*: schematic side views showing the steps of an embodiment of the process according to disclosure with the system from FIG. 1, for the insertion of a flexible sheet.
Figure 5B:
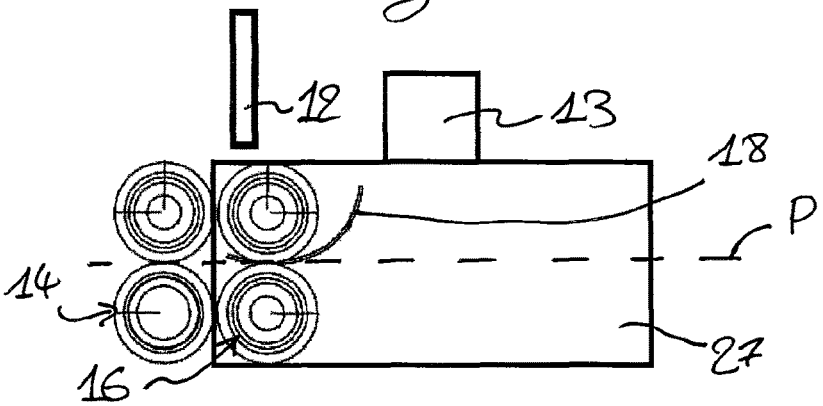
Figure 5C:
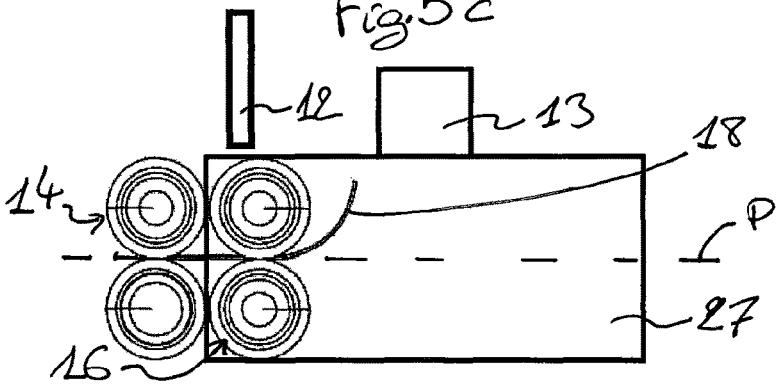
Figure 5D:
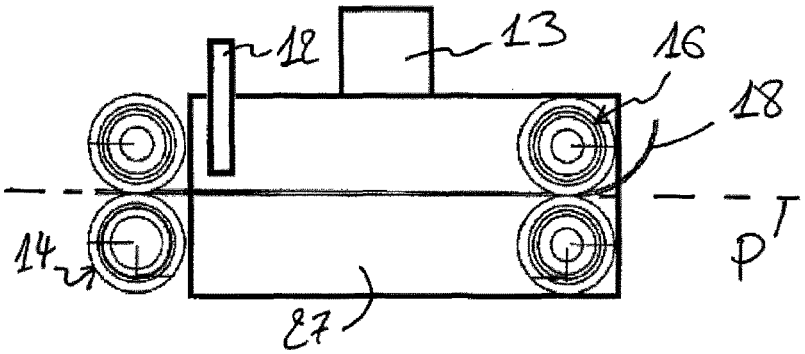

The marking head 12 is then moved to the parking position and the insertion device 27 is actuated to move the braking system 16 to its insertion position. As shown in FIG. 5*b*, in the insertion position, braking system 16 is close to drive system 14, almost in contact with drive system 14.

It can be seen that in the parking position, the marking head 12 is far enough away from the marking plane so that the braking system 16 can move closer to the drive system 14 without coming into contact with the marking head 12.

Then the sheet 18 is pushed or pulled into the drive system between the first pressure roller 22 and the drive roller 20.

When sheet 18 is inserted into the drive system 14, the insertion device 27 is actuated to move the braking system 16 to its operating position. This step can be carried out simultaneously with the start-up of drive roller 20.

In the operating position, the braking system 16 is far enough away from the drive system 14 to allow printing on the sheet metal by the marking head 12.

Sheet 18 is then tensioned and has a flat surface on which the marking head is able to carry out the marking.

The last insertion step is to bring the marking head 12 back into the working position in the marking plane at a distance d from the sheet metal.

In other embodiments not shown, it is advantageous to install a guide table between the braking and drive systems 16 and 14. In this case, it is no longer necessary to bring the braking and drive systems 16 and 14 together when introducing the material. The insertion device can be removed and the system is simplified.

This operation mode could be preferred for users working more exclusively with stiff materials, for example having already been straightened or levelled.

In variants not shown, the guide table can also be replaced by guide rails or any other system for guiding the sheet metal.

For example, guide rails with U-profiles facing each other can be used. The U-profiles are then configured to form housings for the edges of the sheet metal. When a sheet is inserted, it enters the rail recesses after the braking system and is guided to the drive system. In this case, also, the insertion device can be removed.

After inserting a flexible or rigid sheet as described above, the combined forces of the braking system 16 and the drive system exerted on the sheet 18 tension the latter which has a flat surface on which the marking head 12 is able to mark/print.

The marking head 12 is set at a predetermined distance d from the sheet metal between the drive and braking systems.

The marking on sheet 18 can be initialised using a quick-drying ink, e.g. solvent-based. During the marking process, the drive system 14 moves the sheet 18 in front of the marking head 12 along the pass line P. The marking head 12 moves transversely to the pass line P so that it covers the width of the sheet 18. The movements of the marking head and the sheet metal can be synchronised by the control unit 13.

In thermal insulation, the assembly of shaped parts is typically done by screws. For this purpose, holes with a diameter of approx. 3.2 to 3.3 mm must be punched. In embodiments not shown, the hole locations can also be marked on the sheet metal.

The punching work can be carried out, for example, on another machine equipped with a punch. The positioning of the punch is generally done by a low emission laser projection of a circle aligned on a geometrical return marked on the sheet metal.

In order to assist the positioning of the punch, geometrical reminders in any form, such as points or crosses, can be advantageously marked on the circumference of a circle centred on the hole to be punched.

In embodiments not shown, the system further includes a decambering device placed upstream from the system. The decambering device includes, for example, a guide table and a set of three decambering rollers. The decambering device allows the sheet metal to be prepared before insertion into the system so that the sheet metal is relatively flat and easy to handle.

The invention claimed is:

1. A method of marking sheet metal for use in sheet metal work, the method comprising the following steps:

preparing a marking information in digital format;

transmitting the marking information to a control unit of a marking system also comprising a sheet driving system, a braking system, and a marking head;

the sheet metal having a thickness of less than 10 mm;

inserting the sheet metal into the braking system and into the drive system;

exerting on the sheet metal, using the drive system, a drive force in a drive direction;

exerting a braking force on the sheet metal with the braking system opposing the driving force to tension and flatten the sheet metal; and marking the marking information on the tensioned sheet metal by placing the marking head in a marking plane between the drive system and the braking system, the marking plane being located at a distance d from the sheet metal.

2. The method according to claim 1, wherein the marking head is an ink-jet print head using a quick-drying ink.

3. The method according to claim 1, wherein the distance d is less than or equal to 5 mm.

4. The method according to claim 1, wherein the step of marking on the tensioned sheet further comprises the step of:

running the tensioned sheet in front of the marking head, by the combined action of the drive system and the braking system.

5. The method according to claim 1, wherein the step of inserting the sheet metal into the drive system and the braking system comprises the steps of:

inserting the sheet metal into the braking system;

moving the marking head from a working position in the marking plane to a parking position away from the marking plane;

moving the braking system from a working position away from the drive system to an insertion position close to the drive system;

inserting the sheet metal into the drive system from the braking system;

moving the braking system from the insertion position to the working position; and moving the marking head from the parking position to the working position.

6. A system of marking sheet metal for use in sheet metal work, the system comprising: —a drive system configured to exert a driving force on the sheet in a driving direction; —a braking system configured to exert a braking force on the sheet opposing the driving force to tension the sheet; —a marking head placed at a distance d from the sheet metal; and—a control unit configured to at least control the marking head.

7. The marking system according to claim 6, further comprising a sheet metal insertion device on which the braking system is mounted, the insertion device comprising a system for the translatory adjustment of the braking system between two positions:

an insertion position in the vicinity of the drive system, in which the sheet metal can be inserted into the system; and a working position away from the drive system.

8. The marking system according to claim 7, wherein the marking head comprises means for translatory adjustment, in a direction perpendicular to a marking plane, between two positions:

a working position in the marking plane to optimise printing on the sheet; and a parking position away from the marking plane to allow the insertion of a sheet metal in the system.

9. The marking system according to claim 6, further comprising a guide table disposed between the braking system and the guiding system and configured to guide the sheet metal.

10. The marking system according to claim 6, wherein the marking head is configured to project a quick-drying ink.

11. The marking system according to claim 6, wherein the drive and/or braking systems act on the sheet metal by clamping.

12. The marking system according to claim 6, wherein the drive system comprises a pair of rollers including a drive roller driven in rotation by a motor, and a first pressure roller configured to press the sheet against the drive roller.

13. The marking system according to claim 12, wherein the driving roller is made of steel, and the first pressure roller is made of rubber.

14. The marking system according to claim 12, wherein the drive cylinder is rotated by a motor.

15. The marking system according to claim 12, wherein the drive system comprises a gear system, configured to make the rotation of the first pressure roller dependent on that of the drive cylinder.

16. The marking system according to claim 6, wherein the braking system comprises a pair of rollers including a guide roller, and a second pressure roller configured to press the sheet against the guide roller.

17. The marking system according to claim 6, wherein the braking system is a felt press system.

18. The marking system according to claim 6, wherein the system comprises a shear placed downstream from the system.

19. The marking system according to claim 6, wherein the system further comprises a decambering system placed upstream from the system.

20. The marking system according to claim 19, wherein the decambering system comprises a guide table and three decambering rollers.

* * * * *